US006739866B2

(12) United States Patent
Fang

(10) Patent No.: US 6,739,866 B2
(45) Date of Patent: May 25, 2004

(54) COLOR FLAME CANDLES OR LAMPS AND METHOD OF MAKING

(76) Inventor: Yihong Fang, Room 105, No. 8 Building, Kangshanlixincun, Cangshan District, Fuzhou, Fujian 350007 (CN)

( * ) Notice: Subject to any disclaimer, the term of this patent is extended or adjusted under 35 U.S.C. 154(b) by 9 days.

(21) Appl. No.: 10/079,223

(22) Filed: Feb. 20, 2002

(65) Prior Publication Data

US 2002/0090585 A1 Jul. 11, 2002

Related U.S. Application Data

(63) Continuation-in-part of application No. PCT/CN00/00053, filed on Mar. 17, 2000.

(30) Foreign Application Priority Data

Aug. 21, 1999 (CN) ..... 99229255

(51) Int. Cl.[7] ..... F23D 3/24
(52) U.S. Cl. ..... 431/126; 431/320; 431/146
(58) Field of Search ..... 431/126, 320, 431/321, 322, 323, 343, 289, 291, 325, 149, 146, 324

(56) References Cited

U.S. PATENT DOCUMENTS 1,281,077 A * 10/1918 Schlepp ..... 431/323
1,608,518 A * 11/1926 Minrath ..... 431/126
2,512,885 A * 6/1950 Archambeau ..... 431/321
3,790,332 A * 2/1974 Woollard ..... 431/126
3,811,817 A * 5/1974 Mansnerus et al. ..... 431/126
3,994,672 A * 11/1976 Novak ..... 431/320
4,126,408 A * 11/1978 Cox ..... 431/320
4,624,633 A * 11/1986 Bandel ..... 431/320
4,895,511 A * 1/1990 Schmid ..... 431/126
4,911,139 A * 3/1990 Yost ..... 431/324

FOREIGN PATENT DOCUMENTS

JP 61-16990 A * 1/1986
JP 8-121714 A * 8/1996 ..... F23D/3/02

* cited by examiner

*Primary Examiner*—Josiah Cocks
(74) *Attorney, Agent, or Firm*—Yi Li

(57) ABSTRACT

A color flame candle and a color flame candle lamp are disclosed. The color flame candle includes a container with one open end, which contains mixed liquid incendiary agent and color-making agent, a hollow candle head, a wick, a sealing means to seal the open end of the container to prevent evaporation or leak of the fuel, a cap, and a decorative external cover. The color flame candle can further include a bottom open end and a base sealed thereon. In the color flame candle lamp, a heat insulator is positioned at the upper open end of the container as a lamp head. The incendiary agent is stored separately in a storage bottle, and is added into the container prior to use. The candle lamp can be refilled and used repeatedly. The color flame candle, or candle lamp generates a pure and colorful flame for a long period of time.

14 Claims, 4 Drawing Sheets

COLOR FLAME CANDLES OR LAMPS AND METHOD OF MAKING

CROSS REFERENCE TO RELATED APPLICATIONS

This application is a continuation-in-part of PCT patent application No.PCT/CN00/00053 filed on Mar. 17, 2000, which claims priority of Chinese Patent Application No. CN99229255.7 filed on Aug. 21, 1999. All prior applications are herein incorporated by reference in their entirety.

FIELD OF THE INVENTION

This invention relates to a color flame lighting device, more specifically a color flame candle or a color flame candle lamp, and method of making the same.

BACKGROUND OF THE INVENTION

In modern society, candles and lamps are no longer simple lighting tools. Instead, they have become ornaments and have been widely used for occasions such as birthday parties or Christmas celebrations to give the proper atmosphere. In an attempt to improve the decorative properties of candles, color flame candles have been invented.

A currently available color-flame candle is a solid device made of paraffin wax plus a small amount of metal salt as color-making agent. The technology of production is rather complex and the cost is high. These candles leave residues after burning, such as wax, and the quality of the flame color is relatively poor.

Another available color-flame candle is disclosed in Chinese Patent No. ZL90101749. Chinese Patent No. ZL90101749 discloses a method of making a color flame candle which aims to solve the above-mentioned problems. This kind of color flame candle uses methanol, ethanol or butanol as the major liquid incendiary agent contained inside the candle. At the top portion of the inner layer of the candle there is a color-making plate, and the color-making candlewick is set in the annular downward curve of the plate, an incendiary wick placed tangent to the center of the candle body. The working principle is that the major incendiary agent inside the inner layer of the candle provides the incendiary wick the needed fuel. When the wick and the incendiary ion of the wick inside the color-making plate burn at the same time, the flame will produce the desired color. However, experiments have shown that this method of producing color flame candles may have one or more of the following problems.

First, The color-making wick and incendiary wick are both made of cotton, processed with rather complicated chemical methods. Considering that cotton is a flammable substance, when the candle is burning, the major incendiary agent of the wick and the cotton wick will produce a yellow flame which in turn makes the color of the flame impure. Additionally, the production process is rather complex, and the cost is high. Second, this kind of candles uses alcohol, a volatile material, as its major incendiary agent. There is no hermetically sealed device for the incendiary agent. The incendiary agent will evaporate completely with time, rendering it useless. Moreover, the inner layer of this kind of candle is made of heavy gypsum, cement or ceramic material, which increase the weight of the candle. Therefore it is difficult to produce small and elegant birthday candles for use with a birthday cake. Finally, two separate wicks, i.e., the incendiary wick and the color-making wick, are required since the incendiary agent and color-making agent of the candle are not mixed together. These two wicks are processed differently, which increases the complexity and cost of production. Consequently, mass production of the color-flame candles is difficult.

For the foregoing reasons, there is a need for a new or improved color-flame candle or candle-lamp.

DESCRIPTION OF EMBODIMENTS OF THE INVENTION

Figure 1:
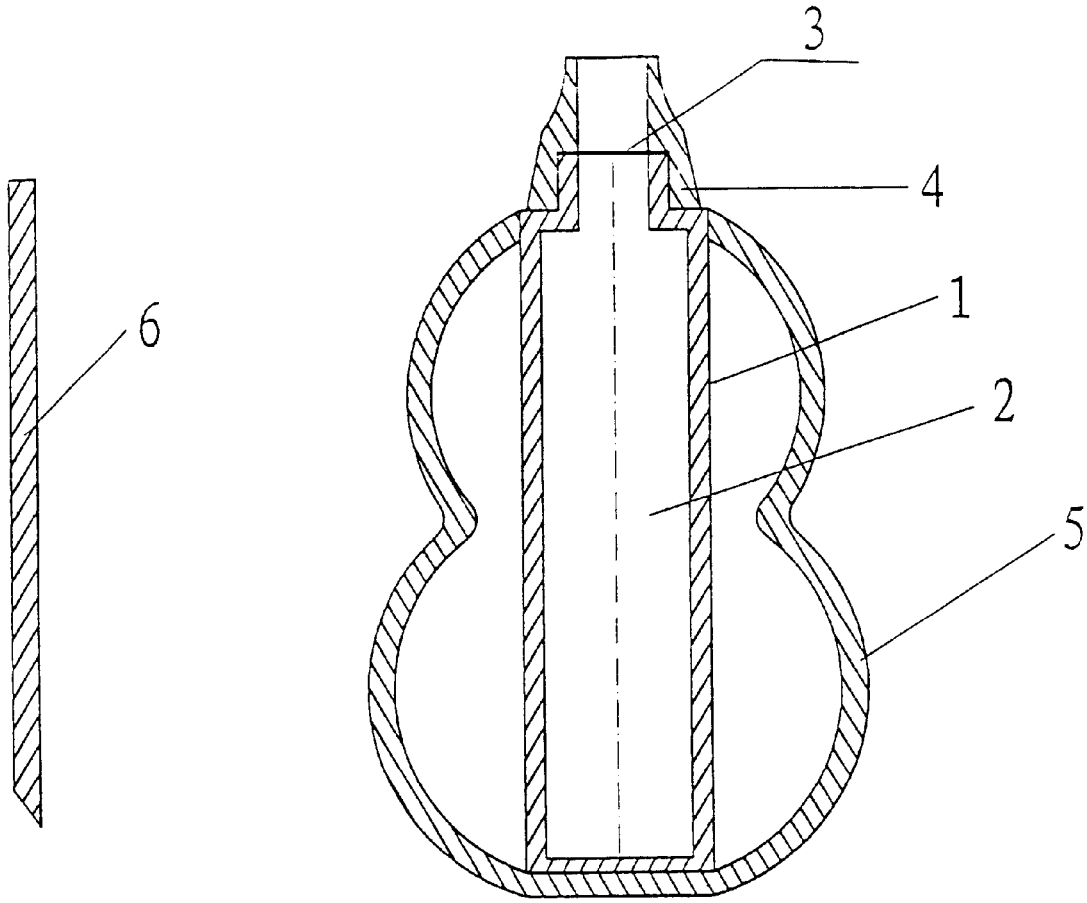
FIG. 1 is a cross-sectional view of a color-flame candle according to one embodiment of the invention.

This invention provides a color flame lighting device capable of produce a desired pure color flame. The color flame lighting device can be color flame candle or a color-flame candle lamp. The color flame candle or color flame candle lamp is simple in structure and easy to produce. It has an excellent fuel sealing property for storage and transportation and is clean and safe to use. The external cover of the color flame candle or candle lamp can be easily processed into various decorative shapes and sizes for a variety of decorative purposes and occasions.

A color flame candle according to one embodiment of the invention comprises: (1) container with at least one open end, wherein the container contains a liquid color flame incendiary agent, which is a mixture of a liquid incendiary agent and a color-making agent; (2) a hollow lighting head as the candle head or as the candle-lamp head; (3) a top cap covered on top of the hollow head; (4) a wick; (5) a sealing means. Optionally, the color flame candle can further comprise a fuel absorbing material which is attached to the inside of the top cap. Moreover, for further enhancing the sealing effect, the top cap includes an inner cap, which provides a double seal for the color flame candle. Additionally, for the purpose of decoration, the color flame candle further comprises an external cover to the container which appears as the body of the candle. The external cover can be processed into various decorative figures. In an alternative embodiment, the dolor flame candle has two open ends, and a base for sealing the bottom open end. When the color flame lighting device is used as a color flame candle lamp, the hollow lamp head can be a heat insulator.

There are at least four ways to produce the color flame candle or color flame candle lamp. First, after a liquid incendiary agent and color-making agent are mixed to form a color flame liquid incendiary agent, the color flame liquid incendiary agent is filled into the container. A sealing film is placed on top of the upper open end of the container through heat treatment or with a glue to seal the container. A hollow head is then placed on top of the upper open end of the candle as a candle head. Afterwards, a decorative external cover is attached to the outside of the container. To use, a wick which has been chemically treated is inserted through the hollow head. The wick penetrates the sealing film, enters the container, and dips into the color flame liquid incendiary agent.

Second, after the liquid incendiary agent and a color-making agent are mixed, the formed color flame liquid incendiary agent is filled into the container. A hollow head is hermetically fixed at the upper open end of the container with a sealing ring. A wick is inserted through the hollow head with one end of the wick inside of the container and the other end extending outside of the hollow head. A top cap is placed on top of the upper open end of the container to seal the hollow head and the wick. The top cap can further include an inner cap to seal the wick, as described in detail hereinafter.

Thirdly, the container has two open ends, upper and bottom open ends. A hollow head is fixed onto the upper open end of the container. A wick is inserted through the hollow head, with one end inside the container and the other end extending outside of the hollow head. A top cap is screwed tightly onto the upper open end of the container. After the liquid incendiary agent and color-making agent are mixed, the formed color flame liquid incendiary agent is filled into the container from the bottom open end. A base is sealed onto the bottom end of the container.

Fourthly, a heat insulator with a center hole is placed on top of the upper open end of the container, with the center hole aligned with the opening of the container, thereby forming a candle lamp head. A wick is inserted through the center hole of the head insulator into the container, and is fixed onto the candle lamp head, with one end of the wick extending outside the candle lamp head. A cap is placed on top of the heat insulator. An external cover made of wax or jelly wax is added to the outside of the container. The external cover is molded into various decorative figures and shapes.

In this invention, a sealing means can be used at the open end of the container. The sealing means can be a sealing film. The upper open end of the container can be directly sealed by the sealing film through heat treatment or with a glue to prevent the color flame incendiary agent inside the container from evaporating or leaking. The sealing means can also be a sealing ring made of thermoplastic/elastic material, which is placed between the hollow candle head and the upper open end of the container, or between the base and the bottom open end of the container.

In the present invention, the hollow candle head, candle lamp head, or heat insulator can be made of materials with heat-resistant and combustion-resistant properties, such as thermosetting plastic, metal, glass, or ceramics. Preferably, heat resistant plastic materials are used, for example, amino resin or fluororesin, because these materials are non-flammable and heat-resistant, and do not deform when in contact with the flame.

In the present invention, the wick can be made of synthetic fiber material. Preferably, the wick is made of polyester fibers. The wick can be treated chemically to eliminate yellow flame generated from burning of the wick, to improve fuel absorbing property of the wick, and to reduce the speed of burning of the wick. The wick can be a soft-wick or a hard-wick so that it can be used for different requirements.

In the present invention, the top cap for the candle or the candle lamp is to seal the wick and the hollow candle head. The cap can be a single layer cap or a double layer cap. The cap can be screwed onto the container through screw threads or tightly attached by friction to the container so that the wick and the hollow candle head are sealed under the cap. The double layer cap is formed by adding an inner cap inside the single layer cap. In the presence of the inner cap, when the cap is screwed onto the container tightly, the bottom edge of the inner cap is pressed onto the surface of the hollow candle cap, which therefore provides a double seal. Optionally, the inner cap has an aperture at the top, and a layer of fuel absorbing material can be placed between the inner cap and the outside cap for absorbing fuel if it leaks through the wick during transportation or storage.

In the present invention, the color flame incendiary agent is made of a liquid incendiary agent and color-making agent. The liquid incendiary agent can be an alcohol, such as methanol, ethanol, propanol, butanol, and mixture thereof. The liquid incendiary agent can also be an aliphatic polyacid or its derivatives, such as fumaric acid, maleic acid and their esters, or a mixture of an alcohol and an aliphatic polyacid or its derivatives. The liquid incendiary agent can also contain an aromatic material. The color-making agent includes, but not limited to, ionic compounds of Li, Na, Co, K, Cr, Cu, Sr, Al, or Ca ions.

In the present invention, the container can be made of plastic or glass, and can be made into various decorative shapes, such as human and animal figures, cartoon characters, and fruits. The color of the container can also be made to be consistent with the color of the flame. Additionally, an external cover can be added to the outside of the container. The external cover can be made of wax, plastic, ceramic, resin, or glass. The external cover can be molded or processed into various decorative shapes. The color of the external cover can also be consistent with the color of the flame.

The present invention has following advantages. (1) The color-making agent and the incendiary agent are mixed together. Therefore, only one wick is required for producing color flame. This simplifies the procedures of manufacturing color flame candles, and reduces the cost of manufacturing. (2) The present invention also addresses the seal of the liquid incendiary agent. Four methods have found to ensure that the liquid incendiary agent does not evaporate or leak. The first method is to directly seal the upper open end of the container with a sealing film using heat treatment or using glue. The second method is to use a sealing ring to seal the hollow candle head and the wick to the upper open end of the container, and to place a cap on top of the hollow candle head and the wick and to ensure the wick is maintained under sealed condition. The third method is to seal the candle head to the upper open end of the container, and use the base to seal the bottom open end of the container after the fuel is filled in. Furthermore, a seal ring can be placed between the base and the bottom open end of the container. And the fourth method is to store the liquid incendiary agent in a separate storage bottle, not in the container of the color flame candle lamp. To use, the user can add the liquid incendiary agent into the container and inserted the pre-assembled wick and the candle lamp head into the container. This type of color flame candle lamp is refillable, and can be used repeatedly. With all four methods described above, the liquid incendiary agent can be sealed effectively to prevent its evaporation or leak. (3) With the present invention, there is only one container because the liquid incendiary agent and the color-making agent are mixed together. Therefore, the manufacturing process is simplified. The container can be directly made of plastic or glass, and be conveniently molded or processed into various decorative shapes and sizes for various types of decorations, or be installed into various decorative external covers. (4) In the present invention, the wick is made of synthetic fiber, such as a polyester fiber, and is chemically treated. Therefore, yellow flame generated from burning of the wick is eliminated, the fuel absorbing property of the wick is improved, and the speed of burning of the wick is reduced. Furthermore, the wick can be a soft wick or a hard wick for use with different candle configurations. Additionally, the wick of the present invention can also be used to replace conventional wick. (5) In the present invention, the hollow candle head is made of heat resistant material, which does not burn, deform or conduct heat when in contact with the flame. The present invention provides color flame candles and color flame candle lamps which generate pure and colorful flames for a long period of time. The color flame candle and color flame candle lamp of the present invention do not generate smoke, embers, or sparks. They are clean and safe to use.

EXAMPLE I

As is shown in FIG. 1, the color flame candle in accordance with an embodiment of the invention includes a container (1) with open upper end. The container is made of plastic container. A liquid incendiary agent (2), for example, ethanol, is filled inside the container. Various color-making agents can be mixed with the incendiary agent to produce various chromatic flames. An aromatic material can also be added into the liquid incendiary agent. When the candle is lit, the incendiary agent and the color-making agent inside burn at the same time, producing different colors of flame and generating superior decorative effect.

There is a layer of sealing film (3) on top of the upper open end of container (1) container, which is attached to the open end by heat treatment or with a glue to prevent the color flame incendiary agent from evaporating or leaking. A hollow head (4) can be attached to the upper open end of the container (1). To use color flame candle, a wick (6) is inserted into hollow head (4) and inserted into container (1). Wick (6) penetrates sealing film (3), with the one end of the wick extending outside hollow head (4). Since when the candle is lit, the flame will touch hollow head (4), hollow head (4) should be non-flammable and heat-resistant. In this embodiment, hollow head (4) made of a non-flammable and heat-resistant material, such as plastic or ceramic. More specifically, hollow head (4) is made of fluororesin.

In this example of the invention, the wick is made of a polyester fiber which can be processed into a hard wick, as known to those skilled in the art. The fuel absorbing property of the wick can be improved by chemical methods so that an impure yellow flame resulting from the burning of the wick can be eliminated.

In some embodiments of the invention, container (1) can be directly made of plastic or glass, and molded into a variety of shapes and sizes, to enhance the decoration features of the color flame candle for serving various decorative purposes and different occasions. The color of the container (1) can be made to be consistent with the color of the flame. Furthermore, an external cover (5) can be attached to the outside of container (1). External cover (5) can be made of wax, plastic, glass, resin, or ceramic material, and can be molded or processed into various decorative figures, such as human and animal figures, cartoon characters, and fruits. In addition, a top cap can be placed on top of the container in order to seal the wick when not in use.

The candle can be made by the following steps. A ready to use color flame incendiary agent is put into container (1). The sealing film (3) is sealed to the upper open end of the container by heat treatment or with glue. Then the sealed upper open end is covered with hollow head (4). Finally, external cover (5) is added on if desired. To use the color flame candle, wick (6) is inserted into hollow head (4). Wick (6) penetrates sealing film (3), and enters into container (1), with one end (the head) of wick (6) extending outside hollow head (4). When in use, the head of wick (6) is lit.

EXAMPLE II

Figure 2:
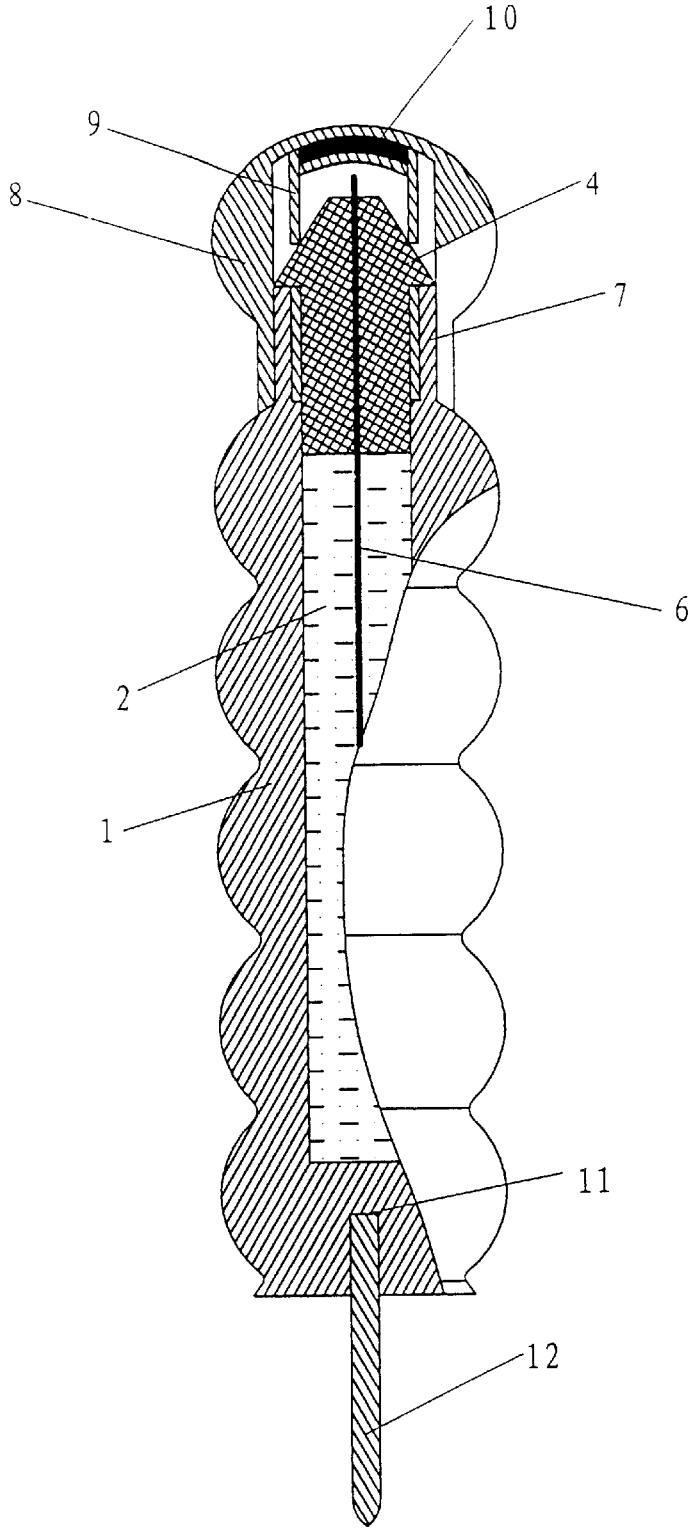
FIG. 2 is a cross-sectional view of a color-flame candle according to the second embodiment of the invention.

As shown in FIG. 2, the color flame candle in accordance with the second embodiment of the invention includes a container (1). The container (1) can be made of plastic, glass, resin, or ceramic material. The container can be processed, by molding or other means, into various decorative figures, such as animals, cartoon characters, and fruits for different purposes and occasions, and to enhance the decorative nature of the color flame candle.

Container (1) has an upper open end, and contains a color flame liquid incendiary agent (2). A candle head (4) is sealed the upper open end of container (1), which seals the incendiary agent inside container (1). The candle head (4) has a center hollow tube for adapting a candlewick. A candlewick (6) is inserted through the center hollow tube of candle head (4) and fixed to candle head (4). As a result, one end of candlewick (6) is soaked in the color flame incendiary agent, with the other end extending outside candle head (4) for burning. There is a sealing ring (7) between candle head (4) and container (1) to seal the candle. Sealing ring (7) is made of thermoplastic or elastic material. As shown in the FIG. 2, the sealing ring (7) is located inside the upper open end of container (1), which provides sealing between container (1) and candle head (4).

To prevent incendiary agent (2) inside container (1) from evaporating along candlewick (6), a candle cap (8) is placed on top of container (1) to seal candlewick (6). A top cap (8) is made of plastic, and it is connected to container (1) through a screw thread to ensure that the top cap does not fall off. Furthermore, the screw thread also provides a curve sealing mechanism. To better seal the burning end of candlewick (6) in cap (8), candle cap (8) can further contains an inner cap (9). Inner cap (9) is made of thermoplastic-elastomer. At the top of inner cap (9) there is an aperture. A piece of fuel absorbing material (10), such as cotton, paper, or fiber, is placed between top cap (8) and inner cap (9). The bottom edge of inner cap (9) is in contact with the downward and outward inclined surface of candle head (4). When top cap (8) is screwed onto container (1), the bottom edge of inner cap (9) is pressed tightly onto candle head (4), which provides two layers of seal to prevent the incendiary agent from evaporating along the candlewick. Candlewick (6) is made of a polyester fiber material which eliminates the yellow flame that results from burning of the candlewick. Hollow candle head (4) is non-flammable and heat-resistant and does not deform when in contact with the flame. In this embodiment, candle head (4) is made of an amino resin.

In this embodiment, the color flame candle further comprises an anchoring stick (12) connected to a connection hole (11) at the bottom of container (1). With the anchoring stick the color flame candle can be inserted in a birthday cake.

The color flame candle can be made by the following steps. First, according to a specific requirement, a ready to use incendiary agent is filled into container (1). Then candlewick (6) is inserted through the center hollow tube of candle head (4) and fixed to candle head (4), with one end of candlewick (6) inside container (1), and the other end extending outside candle head (4). Third, the sealing ring (7) is used to seal candle head (4) and container (1). Then top cap (8) with an inner cap (9) is screwed through screw thread onto the upper end of candle body (1) in order to prevent the incendiary agent from evaporating. To use the color flame candle, remove top cap (8) and light the candlewick head.

EXAMPLE III

Figure 3:
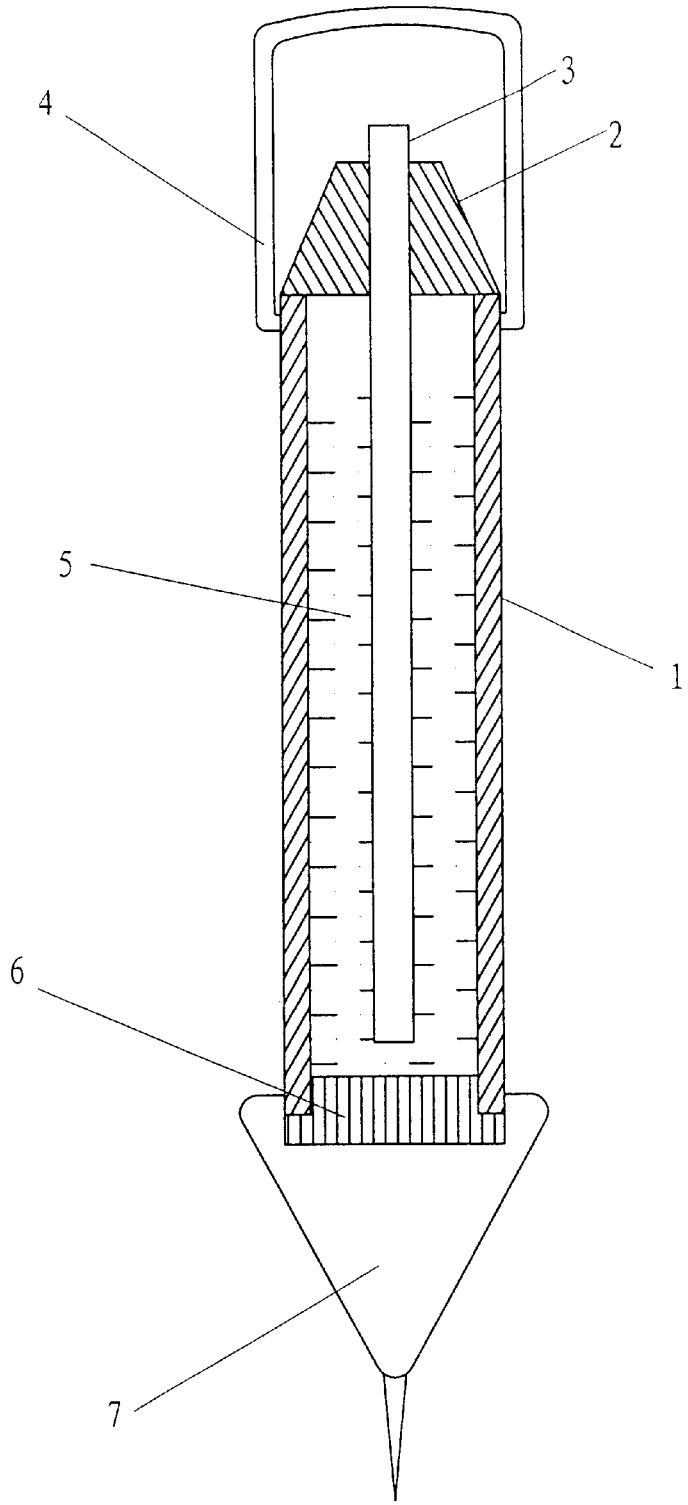
FIG. 3 is a cross-sectional view of a color-flame candle according to the third embodiment of the invention.

As shown in FIG. 3, the color flame candle in accordance with the third embodiment of the invention includes a container (1) with two open ends Container (1) can be made of plastic, glass, resin, or ceramic material, and can be processed, by molding or other means, into various decorative figures, such as animals, cartoon characters, and fruits.

A hollow candle head (2) is fixed with sealing or directly glued to the upper open end of container (1) to prevent hollow candle head (2) to be pulled out. A candlewick (3) is inserted through hollow candle head (2) and fixed to hollow candle head (2). As a result, one end of candlewick (3) is inside container (1), with the other end extending outside hollow candle head (2) for burning. A top cap (4) is fixed at the upper open end of container (1) and on top of hollow candle head (2) to provide a tight seal of candlewick (3). Top cap (4) can further contain an inner cap and fuel absorbing material, as described in Example II. After the liquid incendiary agent and color-making agent are mixed, the formed a color flame liquid incendiary agent (5) is filled into container (1) from the bottom open end. A base (6) is sealed onto the open bottom end of container (1) by glue or directly melted into the body of container (1).

In this embodiment, the color flame candle further comprises an anchoring stick (7) connected to the lower end of container (1) for inserting the candle in a birthday cake. A portion of the anchoring stick has a decorative shape, such as a lotus flower. In this embodiment, the materials and methods of making the candlewick and the candle head are the same as described in Example II.

The color flame candle can be made by the following steps. First, the hollow candle head (2) is fixed with seal or directly melted onto the upper open end of container (1). Then candlewick (3) is inserted through candle head (2) and fixed onto candle head (2). As a result, one end of candlewick (3) is inside container (1), with the other end extending outside candle head (2) for burning. Top cap (4) is fixed tightly to the upper open end of container (1) on top of hollow candle head (2). After the liquid incendiary agent and color-making agent are mixed, the formed a color flame liquid incendiary agent (5) is filled into container (1) from the bottom open end. Base (6) is sealed onto the open bottom end of container (1) by glue or directly melted into the body of container (1). For producing a birthday color flame candle, anchoring stick (7) is connected to the lower end of container (1). A portion of the anchoring stick has a decorative shape, such as a lotus flower.

EXAMPLE IV

Figure 4:
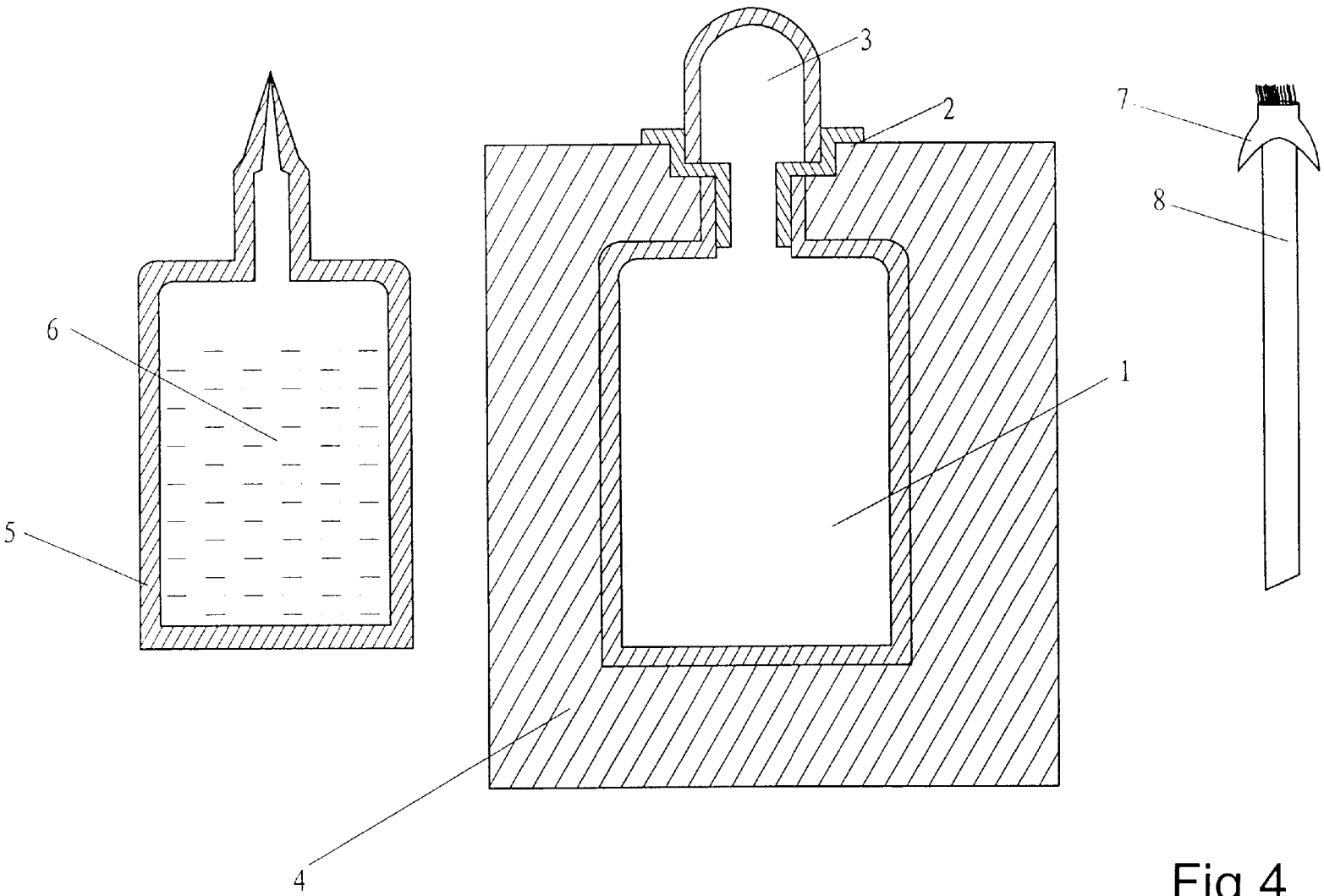
FIG. 4 is a cross-sectional view of a color-flame candle according to the fourth embodiment of the invention.

As shown in FIG. 4, the color flame candle lamp in accordance with thi fourth embodiment of the invention includes a container (1) with one open end. Container (1) can be made of plastic or glass, resin, or ceramic material. A heat insulator (2) is placed at the open end of container (1). Heat insulator (2) is non-flammable and heat-resistant and does not deform when in contact with the flame. In this embodiment, heat insulator (2) is made of an amino resin. Outside container (1), there is an external cover made of wax or jelly wax (4), which can be processed into a variety of decorative shapes. The color flame liquid incendiary agent (6) is placed a sealed storage bottle (5). A wick (8) is inserted through a hollow lamp head (7) and is fixed onto it. Hollow lamp head (7) can be made of metal, glass, or ceramic material. In this embodiment, hollow lamp-head (7) is made of metal. Wick (8) can be made of a polyester fiber material and can be treated by chemical methods so that the wick can produce pure and colorful flame even when it is burned for long period of time. The treated wick can be extinguished without smoke, embers, or sparks, therefore it is clean and safe to use. Prior to use of the candle lamp, a person adds a proper amount of the liquid color flame incendiary agent (6) contained in storage bottle (5) into container (1) through the center hole of the heat insulator (2). Then wick (8), thereon hollow lamp head (7) is fixed to, is inserted into container (1) through the center hole of heat insulator (2). The hollow lamp head (7) is positioned against heat insulator (2). As the result, one end of candlewick (8) is soaked in the color flame liquid incendiary agent, with the other end extending outside hollow lamp-head (7) for burning. In a few minutes the fuel saturates the wick. Then the lamp can be lit to produce a pure and colorful flame. A cap (3) is placed on top of heat insulator (2) when the lamp is not in use, which keeps the wick wet and prevents the incendiary agent (6) inside container (1) from evaporation.

The color flame candle lamp can be made by the following steps. First, container (1) is made of plastic or glass, resin, or ceramic material. In this embodiment, container (1) is made of plastic. Heat insulator (2) is placed at the open end of container (1) Then external cover (4) made of wax or jelly wax is added outside of container (1), and external cover (4) is processed into various of decorative shapes. Cap (3) is placed on top of heat insulator (2). On the other hand, wick (8) is inserted through hollow head (7) and fixed onto it for use. After the liquid incendiary agent and color-making agent are mixed, the formed color flame liquid incendiary agent (6) is filled into storage bottle (5). Storage bottle (5) is sealed prior to use.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A color flame lighting device comprising:

(a) a plastic container containing a mixture of a liquid incendiary agent and a color-making agent, said container having an upper open end, (b) a hollow lighting head made of heat-resistant and non-combustible plastic material selected from the group consisting of amino resin and fluororesin, said hollow light head melted onto the upper open end of the plastic container for securing the hollow lighting head in position, (c) a wick inserted into the container through the hollow lighting head with one end extending out of the hollow lighting head, (d) a sealing means for sealing the upper open end of the container, and (e) a top cap connected to the upper open end of the container and on top of the hollow lighting head.

2. The color flame lighting device of claim 1, wherein the color of the container is the same to the corresponding color of a color flame.

3. The color flame lighting device of claim 1 further comprising an external cover made of a material selected from the group consisting of wax, plastic, resin and ceramic attached to the exterior of the container, wherein the external cover has a decorative shape and color.

4. The color flame lighting device of claim 1, wherein said container further has a bottom open end, and said color flame lighting device further comprises a base, said base being sealed onto the bottom open end of the container after the mixture of the liquid incendiary agent and the color-making agent is filled into the container from the bottom open end.

5. The color flame lighting device of claim 3 further comprising an anchoring stick connected to the bottom of the color flame lighting device.

6. A method of making a color flame lighting device comprising the steps of:

(a) mixing a liquid incendiary agent and a color-making agent to form a color flame liquid incendiary agent, and placing the color flame liquid incendiary agent into a container through an open end of the container, (b) inserting a wick through a hollow lighting head, wherein the wick is fixed to the hollow lighting head, (c) sealing the hollow lighting head to the open end of the container by placing a sealing ring between the hollow lighting head and the open end of the container, thereby one end of the wick is inside of the container and the other end of the wick extends out of the hollow lighting head for burning, (d) placing a double-layer cap onto the upper open end of the container and on top of the hollow lighting head, said double-layer cap comprising a top cap and an inner cap therein, wherein said inner cap has a top portion connected to a top portion of an interior of said top cap and extends downwardly from the top portion; and wherein when the top cap is connected tightly to the upper open end of the container, a bottom edge of the inner cap is pressed against an inclined top surface of the hollow lighting head, thereby forming double seals, and (e) attaching an external cover made of a material selected from the group consisting of wax, plastic, resin and ceramic to the exterior of the container.

7. A method of making a color flame lighting device comprising the steps of:

(a) sealing a hollow lighting head made of a heat-resistant and non-combustible plastic material selected from the group consisting of amino resin and fluororesin to an upper open end of a plastic container by melting the hollow lighting head onto the upper open end with a heat treatment, (b) inserting a wick through the hollow lighting head, wherein the wick is fixed to the hollow lighting head, with one end of the wick inside of the container and the other end of the wick extending out of the hollow lighting head for burning, (c) placing a cap onto the upper open end of the container, said cap being on top of the hollow lighting head to seal the hollow lighting head and the wick, (d) mixing a liquid incendiary agent and a color-making agent to form a color flame liquid incendiary agent, and placing the color flame liquid incendiary agent into the container through a bottom open end of the container, (e) sealing a base onto the bottom open end of the container, and (f) attaching an external cover made of a material selected from the group consisting of wax, plastic, resin and ceramic to the exterior of the container.

8. A color flame lighting device comprising:

(a) a container containing a mixture of a liquid incendiary agent and a color-making agent, said container having an upper open end, (b) a hollow lighting head connected to the upper open end of the container, (c) a wick inserted into the container through the hollow lighting head with one end extending out of the hollow lighting head, (d) a sealing means for sealing the upper open end of the container, and (e) a double-layer cap connected to the upper open end of the container and on top of the hollow lighting head, said double-layer cap comprising a top cap and an inner cap therein, wherein the inner cap has a top portion connected to a top of an interior of said top cap and extends downwardly from the top portion; and wherein when the top cap is connected tightly to the upper open end of the container, a bottom edge of the inner cap is pressed against an inclined top surface of the hollow lighting head, thereby forming double seals.

9. The color flame lighting device of claim 8, wherein the double-layer cap further comprises an aperture at the top portion of the inner cap and a fuel absorbing means placed between the inner cap and the top cap.

10. The color flame lighting device of claim 9, wherein said inner cap is made of thermoplastic or elastic material.

11. The color flame lighting device of claim 9 further comprising an external cover made of a material selected from the group consisting of wax, plastic, resin and ceramic attached to an exterior of the container, wherein the external cover has a decorative shape and color.

12. The color flame lighting device of claim 11, wherein the color of the external cover matches a color of a corresponding color flame produced from said color-making agent.

13. The color flame lighting device of claim 12 further comprising an anchoring stick connected to the bottom of the color flame lighting device.

14. The color flame lighting device of claim 8, wherein said container further has a bottom open end, and said color flame lighting device further comprises a base, said base being sealed onto the bottom open end of the container after the mixture of the liquid incendiary agent and the color-making agent is filled into the container from the bottom open end.

* * * * *